US005127197A

United States Patent [19]

Brukvoort et al.

[11] Patent Number: 5,127,197

[45] Date of Patent: Jul. 7, 1992

[54] ABRASIVE ARTICLE AND PROCESSES FOR PRODUCING IT

[76] Inventors: Wesley J. Brukvoort; Robert N. Howard, both of P.O. Box 33427, St. Paul, Minn. 55133-3427

[21] Appl. No.: 691,147

[22] Filed: Apr. 25, 1991

[51] Int. Cl.[5] ..... B24D 3/06; C08J 5/14; C09K 3/14

[52] U.S. Cl. ..... 51/204; 51/206.4; 51/309

[58] Field of Search ..... 51/394, 395, 397, 398, 51/401, 402, 405, 407, 204, 206.4, 207, 295, 297, 298, 307, 309

[56] References Cited

U.S. PATENT DOCUMENTS

| | | | |
|---|---|---|---|
| 2,492,143 | 12/1949 | Gipple et al. | 51/407 |
| 2,820,746 | 1/1958 | Keeleric | 204/16 |
| 3,860,400 | 1/1975 | Prowse et al. | 51/295 |
| 4,047,902 | 9/1977 | Wiand | 51/295 |
| 4,078,906 | 3/1978 | Green | 51/295 |
| 4,111,667 | 9/1978 | Adams | 51/295 |
| 4,214,877 | 7/1980 | Pemrick | 51/295 |
| 4,256,467 | 3/1981 | Gorsuch | 51/295 |
| 4,288,233 | 9/1981 | Wiand | 51/295 |
| 4,576,612 | 3/1986 | Shukla et al. | 51/394 |
| 4,798,026 | 1/1989 | Cerceau | 51/204 |
| 4,826,508 | 5/1989 | Schwartz et al. | 51/293 |
| 4,874,478 | 10/1989 | Ishak et al. | 204/16 |
| 5,011,511 | 4/1991 | Beck | 51/295 |

FOREIGN PATENT DOCUMENTS

| | | |
|---|---|---|
| 760526 | 6/1954 | United Kingdom . |
| 2164053A | 3/1986 | United Kingdom . |
| 2200920A | 8/1988 | United Kingdom . |
| 90/00105 | 1/1990 | World Int. Prop. O. . |

*Primary Examiner*—Bruce M. Kisliuk
*Assistant Examiner*—Bryan S. Reichenbach
*Attorney, Agent, or Firm*—Gary L. Griswold; Walter N. Kirn; Jeffrey L. Wendt

[57] ABSTRACT

An abrasive article comprising a coated abrasive bonded to a substrate by means of a metallic adhesive and a method for producing the abrasive article by heating.

10 Claims, 1 Drawing Sheet

ABRASIVE ARTICLE AND PROCESSES FOR PRODUCING IT

FIELD OF THE INVENTION

This invention pertains to an abrasive article comprising a coated abrasive which is bonded to a substrate by means of a metallic adhesive and to methods for producing said abrasive article.. The coated abrasive comprises a flexible backing and a plurality of abrasive grains bonded to the backing by means of at least one binder.

DISCUSSION OF THE BACKGROUND

In general, a coated abrasive can be defined as a plurality of abrasive grains bonded to a backing by means of one or more binders. The backing can be rigid like a metal plate or the backing can be flexible like cloth, paper, film, non-wovens or vulcanized fiber. The majority of the coated abrasive backings used in industry today are flexible. The binders can be inorganic materials such as metals or silicates or organic materials such as phenolic resins, ureaformaldehyde resins, epoxy resins or glue. Typical examples of abrasive grains are diamond, cubic boron nitride, fused alumina, ceramic aluminum oxide, silicon carbide, boron carbide, silicon nitride, etc. In the abrasive industry, diamond and cubic boron nitride (CBN) are considered "superabrasives" because their abrasive qualities are vastly superior to the other known abrasive grains. However, these superabrasive grains are also considerably more expensive. In most applications, if a superabrasive grain is employed, a metal binder is used in order to obtain the optimum abrading performance. The other binders listed above typically do not have the strength and integrity necessary to take full advantage of the unique abrading properties associated with superabrasives. Examples of coated abrasives which contain metal bonded superabrasives include: U.S. Pat. Nos. 3,860,400; 4,047,902; 4,078,906; 4,256,467; 4,288,233; 4,826,508 and 4,874,478; British Application 2,200,920 and World Patent Office 90/00105.

It is also known in the art to laminate the coated abrasive to another substrate. For example, British Application 2,164,053 teaches a coated abrasive comprising diamond abrasive grains bonded to a flexible backing by means of an electroplated metal binder. This coated abrasive is then in turn laminated to another substrate by means of an organic laminating adhesive which is heat resistant, solvent resistant and water resistant. However, in certain severe abrading applications, organic laminating adhesives do not exhibit the necessary strength and integrity. Consequently, the laminating adhesive will fail first before the diamond grains fail and the full utilization of the diamond abrasive grain is not achieved.

In some instances, it may be desired to laminate the coated abrasive to a more rigid substrate. U.S. Pat. No. 2,820,746 and British Patent 760,526 disclose a coated abrasive comprising a metal backing with abrasive grains bonded to the backing by means of a metal binder. The coated abrasive is then laminated to a more rigid substrate by the use of a metallic adhesive. However, coated abrasives having metal backings generally are not sufficiently flexible to conform to substrates of varying shapes.

What industry needs today are coated abrasive articles containing flexible backings which are bonded to another substrate by means of a metal adhesive and processes for producing such articles. Such abrasive articles may have substantially any desired shape.

SUMMARY OF THE INVENTION

The present invention solves the above mentioned problems by providing an abrasive article comprising a coated abrasive bonded to a substrate by means of a metallic adhesive and processes for producing such abrasive articles. The coated abrasive comprises a flexible backing and a plurality of abrasive grains bonded to the backing by means of at least one binder. Furthermore, a plurality of metal deposits are present either on the back side of the backing or accessible to a metallic adhesive from the back side of the backing. For example, the metal deposits need not extend through the plane of the back surface of the flexible backing as long as the metal deposits can be contacted by a metallic adhesive applied from the back side of the backing.

The invention also includes processes for preparing such articles by bonding the coated abrasive to a substrate by means of a metallic adhesive.

There are many advantages to this invention. The use of the metallic adhesive material enables the bonded article to withstand much higher loads than organicadhesive bonded material and also increases the water resistance, heat resistance and solvent resistance of the abrasive article. Additionally, the use of the metallic adhesive allows the full utilization of the abrasive grains during abrading since the metallic adhesive is not the weakest link of the abrasive article. Also, the flexible backing feature of the coated abrasive of the invention adapts it to be laminated to a wide variety of geometrically shaped substrates.

In particular, the abrasive article of this invention comprises:

a) a coated abrasive comprising:
   i) a flexible backing having a front side and a back side,
   ii) a plurality of abrasive composites bonded to the front side of the backing, wherein the composites comprise at least one binder and a plurality of abrasive grains, and
   iii) a plurality of metal deposits present on the back side of the flexible backing or accessible to metallic adhesive from the back side of the backing;
b) a substrate; and
c) a metallic adhesive bonded to the metal deposits and to the substrate, and wherein the metallic adhesive serves to bond the metal deposits present on or accessible from the back side of the backing of the coated abrasive to the substrate.

DESCRIPTION OF THE PREFERRED EMBODIMENTS

Figure 1:
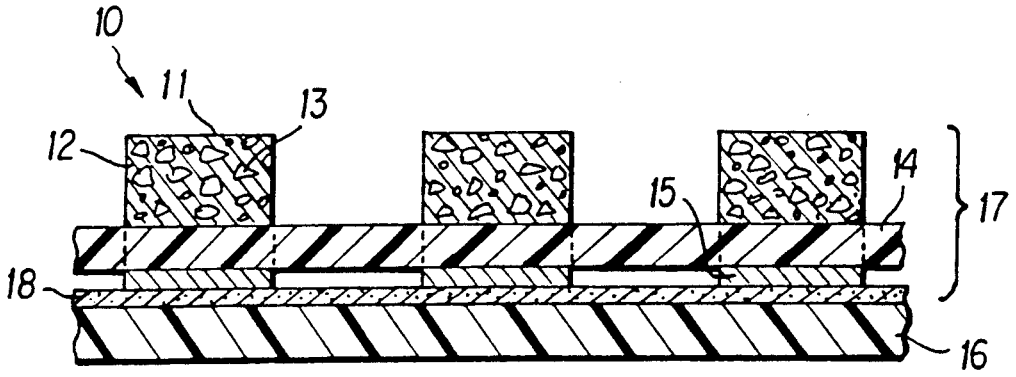
FIG. 1 is a side view of an abrasive article made according to this invention.

Referring to FIG. 1, the abrasive article 10 comprises a coated abrasive 17 which is bonded to a substrate 16 by means of a metallic adhesive 18 between the coated abrasive 17 and the substrate 16. The coated abrasive further comprises a flexible backing 14 having front and back sides, a plurality of abrasive composites 11 bonded to the front side of the backing, and a plurality of metal deposits 15 present on the back side of the backing.

The flexible backing of the coated abrasive can be any material that is flexible. Typically, a flexible backing is capable of being conformed to an arcuate object without imparting undue stress into the backing. Examples of typical flexible backings include paper, polymeric film, vulcanized fiber, polymeric non-wovens, polymeric scrims, fiberglass non-wovens, fiberglass scrims, fibrous non-wovens, treated versions thereof and combinations thereof. Additionally, it is preferred that the backing be porous, for example, like a polymeric scrim. The thickness of the flexible backing will generally range between 5 and 1000 micrometers, preferably between 25 and 250 micrometers.

On the front side of the backing, a plurality of abrasive composites are bonded. The abrasive composites are individual entities and are spaced apart from one another. Thus, there is not a continuous abrasive composite or a singular abrasive composite. The height of the abrasive composite will typically range between about 25 and 800 micrometers, preferably between 120 and 450 micrometers. The diameter of the abrasive composite will typically range between about 0.1 and 5 millimeters, preferably between about 0.2 and 3 millimeters, and, most preferably, between about 0.25 and 2 millimeters. Approximately between about 15 to 90%, preferably about 15 to 50%, of the backing surface area will contain abrasive composites. The abrasive composite can have a random shape or form. Conversely, the abrasive composite can have a geometric shape such as a circle, a triangle, square, rectangle, diamond, etc. In addition, the individual abrasive composites can be arranged in a specified pattern on the backing.

Referring to FIG. 1, the abrasive composites 11 comprise a plurality of abrasive grains 13 and a binder 12. Examples of typical abrasive grains include diamond, diamond-like carbon, cubic boron nitride, fused alumina, heat treated alumina, ceramic aluminum oxide, alumina-zirconia, silicon carbide, garnet, tungsten carbide, boron carbide, titanium carbide, ceria, iron oxide, silica, and silicon nitride. The particle size of the abrasive grain will range from about 0.1 to 100 micrometers, preferably between from about 1 to 100 micrometers. The shape of each abrasive grain can be random or it can be a specified shape. The abrasive composite may comprise a combination of two or more different abrasive grains. The abrasive composite may also comprise diluent inorganic particles such as grey stone, marble or gypsum. Additionally, in certain applications there may be a coating on the periphery of the abrasive grain to improve the adhesion to the binder.

The purpose of the binder is to secure the abrasive grains to the backing. In this invention, it is preferred that a portion of the abrasive grains protrude from the surface of the binder. However, the abrasive grains can be distributed throughout the binder as illustrated in FIG. 1. The binder can be an organic binder or an inorganic binder. Examples of organic binders include phenolic resins, urea-formaldehyde resins, acrylate resins, epoxy resins, melamine resins, aminoplast resins, isocyanate resins, urethane resins, polyester resins and combinations thereof. Examples of inorganic binders include metals, silicates, and silica. The preferred binder is a metallic binder, and examples include tin, bronze, nickel, silver, iron, alloys thereof and combinations thereof. Examples of metallic binders for abrasive articles are found in U.S. Pat. Nos. 3,860,400; 4,047,902; 4,078,906; 4,288,233; 4,826,508 and 4,874,478; British Application 2,200,920 and World Patent Office 90/00105, all of which are hereby incorporated by reference herein. It is most preferred that the binder be applied to the backing by an electroplating process. The abrasive grains are applied simultaneously during the electroplating process.

If the binder is applied by an electroplating process, the flexible backing of the invention must be porous and non-conductive or else the backing must contain non-conductive regions.

The coated abrasive further comprises a plurality of metal deposits either present on the back side of the flexible backing or even present on the front side of, or in the pores or openings of, the backing such that they are accessible to metallic adhesive applied from the back side of the backing. Like the abrasive composites, the metal deposits are deposited on discrete areas that are spaced apart from one another. The height of the metal deposits will typically range between about 25 to 800 micrometers. The diameter of the metal deposits will typically range between about 0.1 to 5 millimeters, preferably between 0.2 to 3 millimeters, and, most preferably, between about 0.25 and 2 millimeters. Approximately between about 15 to 90%, preferably about 20 to 50%, of the backing back side surface area, or a surface area accessible to metallic adhesive applied from the back side, contains these metal deposits. Examples of metals suitable for these deposits include tin, iron, bronze, nickel, silver, and combinations and alloys thereof.

In the preferred mode of the invention, the flexible backing is a polymeric scrim, and the binder is a nickel metal that is electroplated. During the electroplating process, the flexible backing is placed over an electrically conductive metal drum and the nickel binder is electroplated through the scrim. It is inherent in this process that a portion of the nickel will remain on the back side of the backing, thus forming the metal deposits. The remainder of the nickel will be present on the front side of the backing as the binder. The thickness of this metal deposit is typically the distance between the back side of the backing and the metal drum. This preferred process for preparing the coated abrasive is further described in U.S. Pat. No. 4,256,467, which is hereby incorporated by reference herein.

Other ways of applying the metal deposits to the back side of the backing include screen printing and powder metallurgical methods which are both well known in the art. As mentioned above, it is not necessary that the metal deposits extend entirely through the flexible backing so long as the deposits are accessible to metallic adhesive applied from the back side of the backing. For example, the electroplated binder metal may extend partially into the pores or openings of the flexible backing so that these deposits can be contacted with the metallic adhesive.

The coated abrasive is bonded to a substrate by means of a metallic adhesive. The thickness of the metallic adhesive should be between about 2 to 100 micrometers, preferably between about 10 to 50 micrometers. Examples of metallic adhesives include metal solder and metal brazing.

A metal solder has a melting point less than about 425° C. Examples of metallic solder adhesives include alloys of tin and lead. In some instances, other metals such as antimony, bismuth, cadmium, silver or arsenic are added to alter the properties of the metallic solder.

The solder wets the surface of the metal deposit and then freezes into place. This in turn forms the bond between the coated abrasive and the substrate. The metallic adhesive does not adhere to the flexible backing, only to the metal deposits. The surface of the metal deposit should be free from any oxide or other film so that the solder readily wets the surface and a good bond is achieved. It has been determined that about 20 micrometers in thickness of metal solder is required to form a satisfactory bond between the substrate and the coated abrasive. Typically, thicknesses of metal solder above 150 micrometers are not preferred because this results in excessive metal solder which can lead to other problems.

In brazing, a brazing metal or alloy is selected which has a melting temperature below the maximum temperatures that the coated abrasive backing and the substrate can withstand. Brazing paste alloys are particularly suitable for use in the present invention. In brazing, a metallurgical bond forms between the metal deposits and the substrate. Typically, brazing will provide a stronger bond than soldering. Examples of brazing metals include copper, gold, silver, and complex alloys of aluminum, nickel, magnesium, gold, cobalt, silver and palladium.

In making the abrasive article of the invention, the metallic adhesive is placed between the metal deposits of the coated abrasive and the substrate and the assembly is heated to approximately the processing temperature of the metallic adhesive. Alternatively, the metallic adhesive may be applied either to the metal deposits, the substrate or to both prior to assembly. The preferred method is to coat the metallic adhesive onto the substrate prior to contacting the metal deposits of the coated abrasive. The preferred manner of heating is vapor heating or vapor phase reflow solder heating. Vapor heating is done by placing the coated abrasive/metallic adhesive/substrate assembly into a heated vapor bath for a time sufficient to bond the coated abrasive to the substrate. The preferred vapor bath is one formed using a fluorinated organic compound such as Fluorinert FC-70, commercially available from the 3M Company, St. Paul, Minn. This is the preferred method of heating, since the coated abrasive is quickly and uniformly heated while minimizing any potential degradation of the backing.

Figure 2:
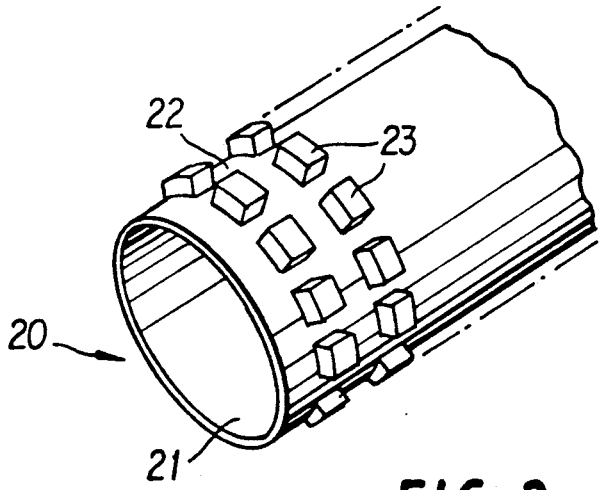
FIG. 2 is a perspective view of one aspect of this invention.

The substrate can be any conventional substrate. Examples of such substrates include metals, ceramics, high temperature plastics, etc. It may have any shape desired for the abrasive article, such as a flat sheet, a round tube, a convex object, a concave object or a convoluted object. Referring to FIG. 2, in the abrasive article 20, the coated abrasive 22, which contains the abrasive composites 23, is adhered to a tube 21. It is preferred to coat the substrate with solder before the coated abrasive is applied. This embodiment illustrates that an advantage of this invention is that it allows a flexible coated abrasive to be bonded to any geometrically shaped substrate.

The following non-limiting examples will further illustrate the invention.

EXAMPLE 1

The coated abrasive backing for this example consisted of a polyester scrim backing purchased from Soatofil under the style number HD63. A nickel metal binder was electroplated through the scrim backing and 74 micrometer average particle size diamond abrasive grains were deposited into the nickel binder. During the electroplating process, some of the nickel remained on the back side of the backing to form the metal deposits. The method of applying the nickel and the diamond to form the abrasive composites was essentially done in the same manner as taught in U.S. Pat. No. 4,256,467. The abrasive composites were generally circular in nature and had a diameter of approximately 660 micrometers at the base. The backing surface area that was covered with the abrasive composites was approximately 20%.

The coated abrasive was bonded to a substrate by means of a 50/50 weight ratio tin/lead metal solder. The substrate was a 165 micrometer thick circuit board that contained a 25 micrometer thick coating of metal solder. The substrate/metal solder combination was converted into a disc which had a 3.5 cm inner diameter and a 7.6 cm outer diameter. The coated abrasive was laid on top of the disk such that the metal deposits on the back side of the backing were in contact with the solder and the abrasive composites faced outward. There was approximately 5 to 10% extra coated abrasive material to allow for some shrinkage. Then an aluminum pressure plate having an outer diameter of 8.3 cm was placed over the coated abrasive/metal solder/substrate assembly so that the aluminum pressure plate contacted the abrasive composites only. The aluminum pressure plate/coated abrasive/metal solder/substrate assembly was clamped together and inserted into a vapor bath for 90 seconds. The vapor bath was a 3M Company product designated as Fluorinert electronic liquid FC-70, which had a boiling point of 215° C. The 90 seconds of exposure to the vapor bath allowed the materials to be brought up to temperature and was sufficient time for the metal solder to bond to the metal deposits. The materials were then cooled to room temperature before the clamps were removed. Additionally, any excess overlapped coated abrasive was removed from the disc. The resulting abrasive article was examined under a microscope and it was determined that the coated abrasive was adequately bonded to the substrate by means of the metal solder.

EXAMPLE 2

The abrasive article for Example 2 was made in the same manner as Example 1 except that a different substrate was employed. The substrate for Example 2 was a copper tubing which had a 5.4 cm outer diameter and was 5.1 cm in length. A 50/50 tin/lead solder was coated over the outer diameter of the tubing to a solder coating thickness of about 25 micrometers. The resulting abrasive article was examined under a microscope and it was determined that the coated abrasive was adequately bonded to the substrate by means of the metal solder.

Various modifications and alterations of this invention will become apparent to those skilled in the art without departing from the scope and spirit of this invention, and it should be understood that this invention is not to be unduly limited to the illustrative embodiments set forth herein.

Obviously, numerous modifications and variations of the present invention are possible in light of the above teachings. It is therefore to be understood that within the scope of the appended claims, the invention may be practiced in manners other than these specifically described herein.

What is claimed as new and desired to be secured by letters patent of the United States is:

1. An abrasive article comprising:

a) a coated abrasive comprising:

i) a flexible backing having a front side and a back side;

ii) a plurality of abrasive composites bonded to the front side of the backing, wherein the composites comprise at least one binder and a plurality of abrasive grains; and iii) a plurality of metal accessible to metallic adhesive, selected from the group consisting of a metal solder and a brazing metal, from the back side of the backing;

b) a substrate; and c) a metallic adhesive bonded both to the metal deposits and to the substrate, the metallic adhesive serving to bond the coated abrasive to the substrate.

2. An abrasive article according to claim 1, wherein the metal adhesive is a metal solder comprising an alloy of tin and lead.

3. An abrasive article according to claim 1, wherein the binder of the abrasive composite is a metallic binder.

4. An abrasive article according to claim 3, wherein the metallic binder is nickel.

5. An abrasive article according to claim 4, wherein both the metallic binder and the metal deposits are nickel.

6. An abrasive article according to claim 1, wherein the substrate is circuit board.

7. An abrasive article according to claim 1, (a) the abrasive grains are selected from the group consisting of diamonds, cubic boron nitride, and mixtures thereof;

(b) both the binder for the abrasive grains and the metal deposits are nickel;

(c) the flexible backing is a polyester scrim backing;

(d) the substrate is circuit board; and (e) the metallic adhesive is tin/lead metal solder.

8. An abrasive article according to claim 1, wherein:

(a) the abrasive grains are selected from the group consisting of diamonds, cubic boron nitride, and mixtures thereof;

(b) both the binder for the abrasive grains and the metal deposits are nickel;

(c) the flexible backing is a polyester scrim backing;

(d) the metallic adhesive is tin/lead metal solder;

(e) the substrate is copper tubing.

9. An abrasive article according to claim 1, wherein the substrate is a flat sheet, a round tube, a convex object, a concave object or a convoluted object.

10. An abrasive article according to claim 1, wherein:

i) the flexible backing is selected from the group consisting of:

A) paper;

B) polymeric film;

C) vulcanized fiber;

D) polymeric non-wovens;

E) polymeric scrims;

F) fiberglass non-wovens;

G) fiberglass scrims;

H) fibrous non-wovens;

I) treated versions thereof; and

J) combinations thereof; and ii) the abrasive grains are selected from the group consisting of:

A) diamond;

B) diamond-like carbon;

C) cubic boron nitride;

D) ceramic aluminum oxide;

E) alumina;

F) alumina-zirconia;

G) silicon carbide;

H) garnet;

I) tungsten carbide;

J) ceria;

K) iron oxide;

L) silica;

M) silicon nitride; and

N) mixtures thereof.

* * * * *

UNITED STATES PATENT AND TRADEMARK OFFICE

CERTIFICATE OF CORRECTION

PATENT NO. : 5,127,197

DATED : July 7, 1992

INVENTOR(S) : Wesley J. Bruxvoort and Robert N. Howard

It is certified that error appears in the above-identified patent and that said Letters Patent is hereby corrected as shown below:

TITLE PAGE:

[75] Inventors: "Brukvoort" should read -- Bruxvoort --

Insert: [73] Assignee: Minnesota Mining and Manufacturing Company
St. Paul, Minn.

Signed and Sealed this

Twenty-eighth Day of September, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,127,197

DATED : July 7, 1992

INVENTOR(S) : Wesley J. Bruxvoort, and Robert N. Howard

It is certified that error appears in the above-identified patent and that said Letters Patent is hereby corrected as shown below.

Col. 3, line 38 delete "diamond-like carbon,"

Signed and Sealed this

Twenty-second Day of February, 1994

Bruce Lehman

*Attest:*

BRUCE LEHMAN

*Attesting Officer*

*Commissioner of Patents and Trademarks*